US007847760B2

(12) United States Patent
Jeong

(10) Patent No.: US 7,847,760 B2
(45) Date of Patent: Dec. 7, 2010

(54) PIXEL CIRCUIT, ORGANIC LIGHT EMITTING DISPLAY USING THE PIXEL CIRCUIT AND DRIVING METHOD FOR THE DISPLAY

(75) Inventor: Jin Tae Jeong, Seoul (KR)

(73) Assignee: Samsung Mobile Display Co., Ltd., Gyeonggi-do (KR)

( * ) Notice: Subject to any disclaimer, the term of this patent is extended or adjusted under 35 U.S.C. 154(b) by 1286 days.

(21) Appl. No.: 11/392,067

(22) Filed: Mar. 29, 2006

(65) Prior Publication Data

US 2006/0248420 A1 Nov. 2, 2006

(30) Foreign Application Priority Data

Apr. 28, 2005 (KR) ..... 10-2005-0035765

(51) Int. Cl.
*G09G 3/30* (2006.01)
*G09G 3/32* (2006.01)

(52) U.S. Cl. ..... 345/76; 345/82

(58) Field of Classification Search ..... 345/76, 345/77, 82, 83; 315/169.1, 169.3, 169.4
See application file for complete search history.

(56) References Cited

U.S. PATENT DOCUMENTS

| | | | | |
|---|---|---|---|---|
| 6,864,637 | B2 | 3/2005 | Park et al. | |
| 2005/0088378 | A1 * | 4/2005 | Ozawa et al. | 345/76 |
| 2005/0140605 | A1 * | 6/2005 | Jung | 345/76 |
| 2006/0139264 | A1 * | 6/2006 | Choi et al. | 345/76 |

* cited by examiner

*Primary Examiner*—Kevin M Nguyen
(74) *Attorney, Agent, or Firm*—Knobbe Martens Olson & Bear LLP

(57) ABSTRACT

A pixel circuit and an organic light emitting display using the pixel circuit and a pixel circuit driving method capable of displaying an image of desired brightness are disclosed. The pixel provides a current for an organic light emitting diode which is not affected by a kickback voltage which occurs at the end of an initialization phase. The pixel also provides a current for an organic light emitting diode which is substantially not affected by a voltage drop in the power supply providing the current.

21 Claims, 8 Drawing Sheets

PIXEL CIRCUIT, ORGANIC LIGHT EMITTING DISPLAY USING THE PIXEL CIRCUIT AND DRIVING METHOD FOR THE DISPLAY

CROSS-REFERENCE TO RELATED APPLICATIONS

This application claims the benefit of Korean Patent Application No. 2005-35765, filed on Apr. 28, 2005, in the Korean Intellectual Property Office, the disclosure of which is incorporated herein by reference.

BACKGROUND OF THE INVENTION

1. Field of the Invention

The present invention relates to a pixel, an organic light emitting display using the pixel circuit and a driving method, and more particularly, to a pixel and an organic light emitting display using the pixel and a driving method capable of displaying an image of desired luminance 2. Description of the Related Art Various flat panel displays have been developed so as to have less weight and bulk than that of a cathode ray tube (CRT). Flat panel displays include liquid crystal displays (LCDs), field emission displays (FEDs), plasma display panels (PDPs), organic light emitting displays, etc. An organic light emitting display presents an image using organic light emitting diodes that generate light from the recombination of electrons and holes. Such an organic light emitting display has advantages in that it has a high response speed, and operates in a low power consumption.

FIG. 1 is a circuit view showing a conventional organic light emitting display. With reference to FIG. 1, a pixel 10 of the conventional organic light emitting display includes an OLED, and a pixel circuit 12 for providing a current to the OLED. An anode of the OLED is connected to the pixel circuit 12, and a cathode is connected to the second power source ELVSS. This OLED generates a luminance corresponding to a current provided from the pixel circuit 12.

The pixel circuit 12 controls a quantity of current that is provided from the first power source ELVDD to the OLED in response to a data signal which is provided from a data line Dm. To accomplish this, the pixel circuit 12 includes the first transistor M1, the second transistor M2, the third transistor M3, the fourth transistor M4, the fifth transistor M5, the first capacitor C1, and the second capacitor C2. A gate of the first transistor M1 is connected to the n (n is a positive integer)-th scan line Sn, and the first electrode is connected to the m (m is a positive integer)-th data line Dm. And, the second electrode of the first transistor M1 is connected to the first node N1. The first transistor M1 is turned-on when a scan signal is provided to the n-th scan line Sn, such that a data signal provided from the data line Dm is provided to the first node N1. On the other hand, the first electrode is set as either a source or a drain, and the second electrode is set as the other. For example, the first electrode is set as the source and the second electrode is set as the drain.

The gate of the second transistor M2 is connected to the second node N2, and the first electrode of the second transistor M2 is connected to the first power source ELVDD. The second electrode of the second transistor M2 is connected to the first electrode of the fifth transistor M5. The second transistor M2 provides the first electrode of the fifth transistor M5 with a current corresponding to a voltage provided to the second node N2.

The gate of the third transistor M3 is connected to the (n−1)-th scan line Sn−1, and the first electrode of the third transistor M3 is connected to the first power source ELVDD. The second electrode of the third transistor M3 is connected to the first node N1. Therefore, the third transistor M3 is turned on to allow the first power source ELVDD to be electrically connected to the first node N1 when a scan signal is provided to the (n−1)-th scan line Sn−1.

The gate of the fourth transistor M4 is connected to the (n−1)-th scan line Sn−1, and the first electrode of the fourth transistor M4 is connected to the second node N2. The second electrode of the fourth transistor M4 is connected to the first electrode of the fifth transistor M5. Therefore, the fourth transistor M4 is turned on so as to allow the second node N2 to be electrically connected to the first electrode of the fifth transistor M5 when a scan signal is provided to the (n−1)-th scan line Sn−1.

The gate of the fifth transistor M5 is connected to the (n−1)-th scan line Sn−1, and the first electrode of the fifth transistor M5 is connected to the second electrode of the second transistor M2. The second electrode of the fifth transistor M5 is connected to an OLED. Therefore, the fifth transistor M5 is turned off when the scan signal is provided to the (n−1)-th scan line Sn−1 and turned on when not, such that a current from the second transistor M2 flows to the OLED. Accordingly, the fifth transistor M5, which has a different type than the third and fourth transistors M3 and M4, is used. For example, if the third and fourth transistors M3 and M4 are PMOS, the fifth transistor M5 is NMOS. The first capacitor C1 is charged to a voltage corresponding to a data signal via the first transistor M1 while the scan signal is provided to the n-th scan line Sn.

FIG. 2 is a timing diagram showing driving waveforms provided to the scan lines and data line depicted in FIG. 1. Hereinafter, the operation of the pixel 10 will be explained by reference to FIG. 1 and FIG. 2. Referring to FIG. 2, a scan signal is provided to the (n−1)-th scan line Sn−1, and a data signal is provided to the m-th data line Dm. When the scan signal is provided to the (n−1)-th scan line Sn−1, the third and fourth transistors M3 and M4 are turned on, and the fifth transistor M5 is turned off. The first node N1 is electrically connected to the first power source ELVDD when the third transistor M3 is turned on. The second node N2 is electrically connected to the first electrode of the second transistor M2 when the fourth transistor M4 is turned on. A voltage difference between the first node N1 and the second node N2 corresponding to a threshold voltage of the second transistor M2 is charged across the second capacitor C2. Also, when the fifth transistor M5 is turned off, current is not provided to the OLED. And, since the first transistor M1 is off while the scan signal is provided to the (n−1)-th scan line Sn−1, the data signal which is provided to the m-th data line Dm is not provided to the pixel circuit 12. Thus, the first node N1 is initialized to the voltage of the first power supply ELVDD, and the second node N2 is initialized to the voltage of the first power supply ELVDD minus a threshold voltage of the second transistor M2.

Then, the scan signal is provided to the n-th scan line Sn, and the data signal is provided to the m-th data line Dm. When the scan signal is provided to the n-th scan line Sn, the first transistor M1 is turned on, and the data signal on to the m-th data line Dm is provided to the first node N1. At this time, the first capacitor C1 is charged to a voltage that corresponds to a difference between the voltage of the first power supply ELVDD and the voltage of the data signal applied to the first node N1.

Thereafter, the second transistor M2 controls the quantity of current which flows into the OLED through the fifth transistor M5 according to the voltage across the first and second capacitors C1 and C2. The OLED emits light with brightness corresponding to the quantity of current that is provided from the second transistor M2.

However, it is a problem that the prior art pixel 10 can not display an image having a desired brightness because of a kickback phenomenon. When the fourth transistor M4 is turned off, an electric charge of a parasitic capacitor between the gate and the first power source is redistributed, such that a kickback voltage is generated. Some of the charge that is generated from the fourth transistor M4 goes to the second node N2 and changes the voltage of the second node N2. When the voltage of the second node N2 is changed, the voltage of the first node N1 is also changed, resulting in the voltage across the first capacitor C1 changing. Accordingly, the voltages at the first node N1 and the second node N2 are disturbed and are not the desired initialization voltages discussed above. This disturbance affects the current supplied to the OLED, and therefore the brightness. Because the magnitude of the disturbance is affected by such factors as the capacitance values of the gate-source capacitor of the fourth transistor M4 and the parasitic capacitors on the second node N2, which vary from pixel to pixel, the current and brightness also varies from pixel to pixel.

Also, in the prior art pixel 10, the first capacitor C1 is charged to a voltage corresponding to a difference between the voltage of the first power source ELVDD and the voltage of the data signal. Therefore, when charging the first capacitor C1 with a desired voltage, the first power source ELVDD should be held constant. However, the voltage of the first power source ELVDD tends to vary according to the position of each of the pixels 10 in an array. Therefore, the first capacitors C1 of each of the pixels across the array are not consistently charged to the desired voltage. In other words, because the voltage value is set according to the position of each of the pixels 10 in the array, an image is not displayed with a uniform brightness in the prior art.

SUMMARY OF CERTAIN INVENTIVE ASPECTS

Accordingly, it is an aspect of the present invention to provide a pixel and an organic light emitting display using the same, and a driving method capable of displaying an image of desirable luminance, respectively.

BRIEF DESCRIPTION OF THE DRAWINGS

These and/or other aspects and advantages of various embodiments will become apparent and more readily appreciated from the following description of inventive aspects, taken in conjunction with the accompanying drawings of which.

DETAILED DESCRIPTION OF CERTAIN INVENTIVE EMBODIMETNS

Figure 1:
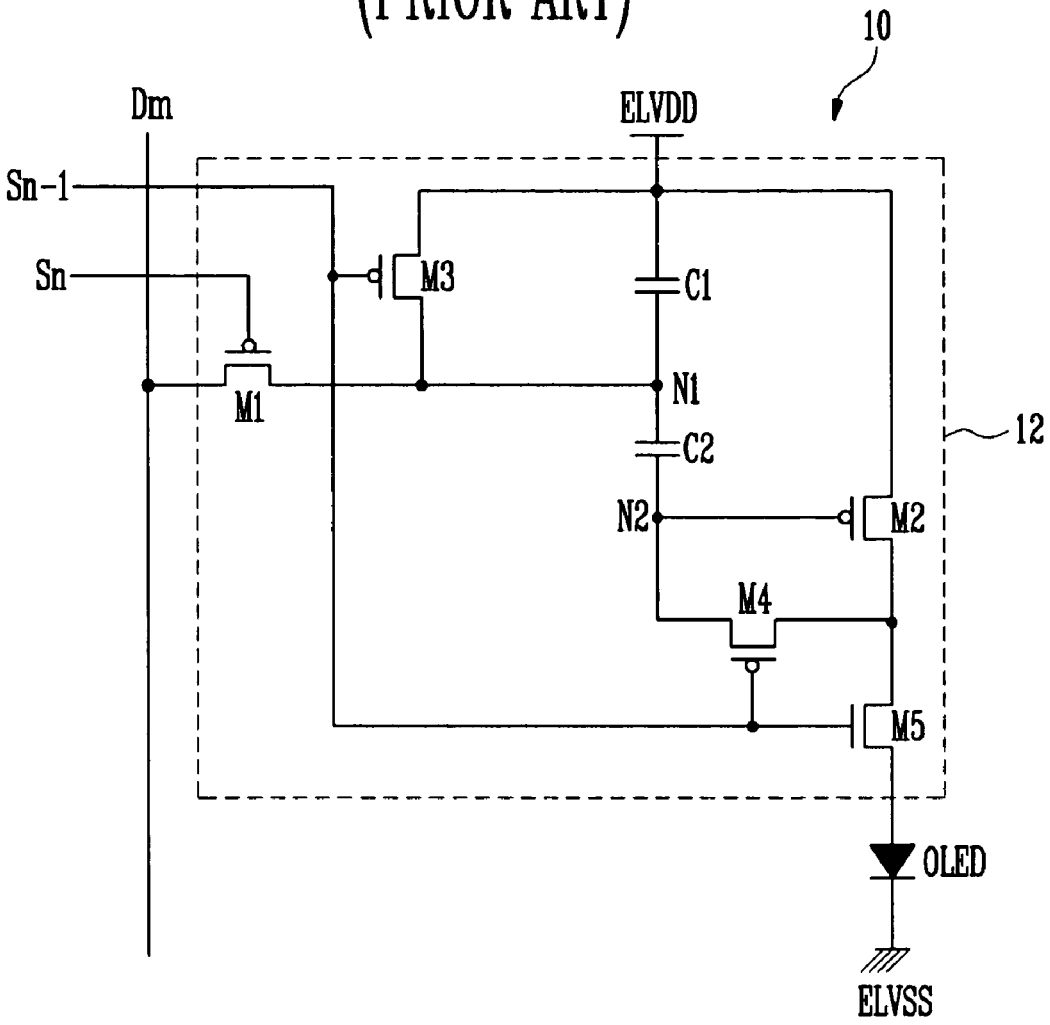
FIG. 1 (PRIOR ART)
FIG. 1 is a schematic diagram showing a conventional organic light emitting display.
Figure 2:
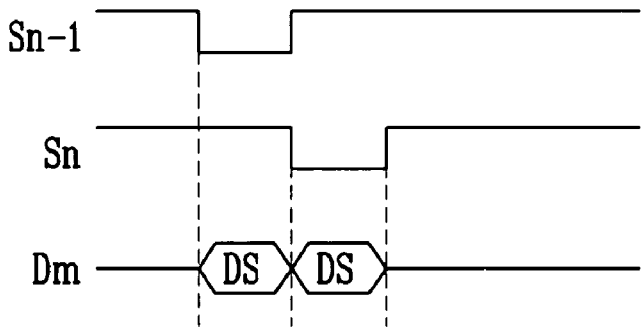
FIG. 2 (PRIOR ART)
FIG. 2 is a timing diagram showing driving waveforms provided to the scan lines and data line depicted in FIG. 1.

Hereinafter, embodiments according to the present invention will be described with reference to the accompanying drawings. When a first element is connected to a second element, the first element may be directly connected to the second element or may be indirectly connected to the another element via a third element. Also, like reference numerals refer to like elements throughout.

Figure 3:
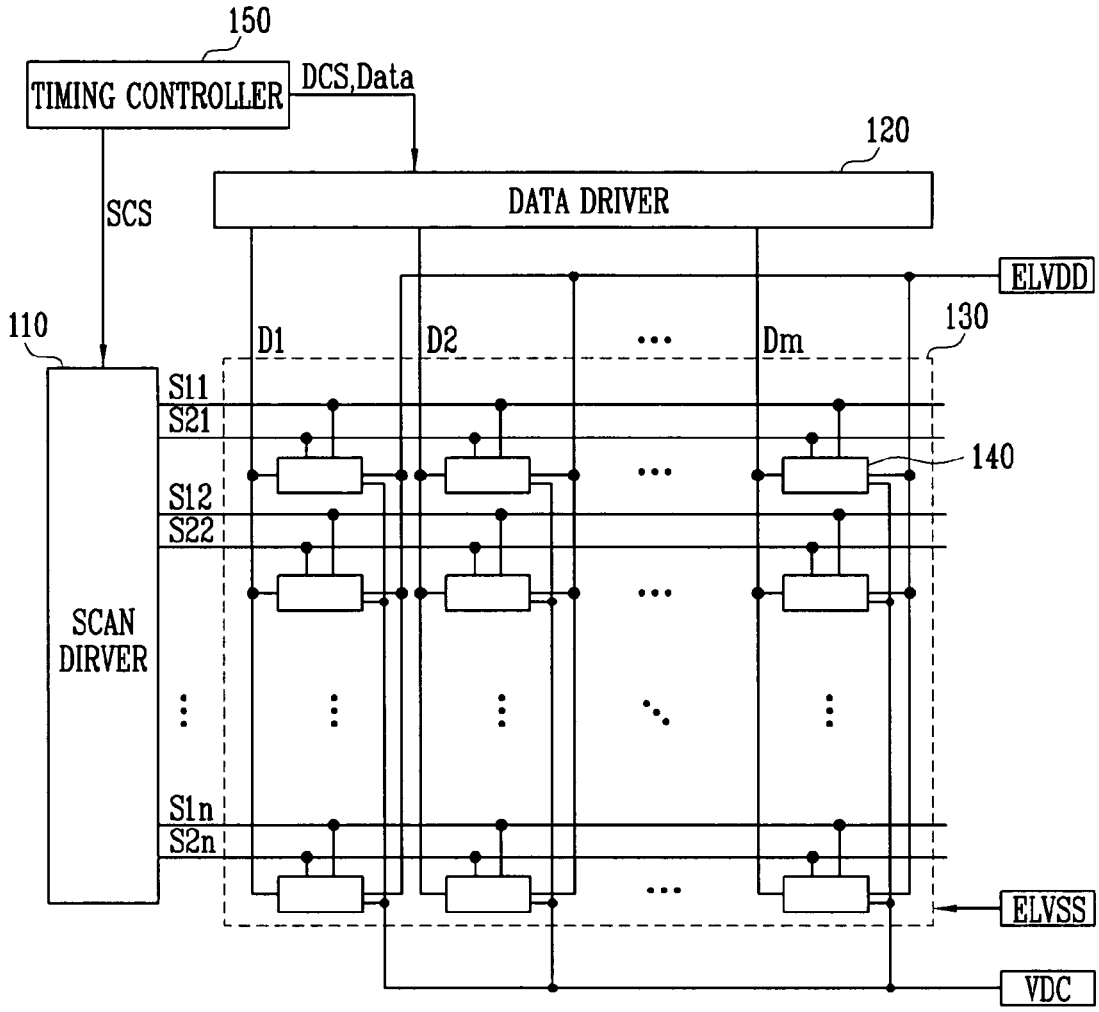
FIG. 3 is a schematic diagram showing an organic light emitting display according to one embodiment of the present invention.

FIG. 3 is a schematic diagram showing an organic light emitting display according to one embodiment of the present invention.

Referring to FIG. 3, an organic light emitting display according to one embodiment includes first scan lines S11 through S1*n*, a pixel portion 130 including pixels 140 which are formed at crossing areas of the second scan lines S21 through S2*n* and data lines D1 through Dm, a scan driver 110 for driving the first scan lines S11 through S1*n* and the second scan lines S21 through S2*n*, a data driver 120 for driving the data lines D1 through Dm, and a timing controller 150 for controlling the scan driver 110 and the data driver 120.

The timing controller 150 generates a data drive control signal DCS and a scan drive control signal SCS using an externally supplied signal (not shown). The data drive control signal DCS and the scan drive control signal SCS generated by the timing controller 150 are provided to the data driver 120 and the scan driver 110, respectively.

The scan driver 110 receives the scan drive control signal SCS from the timing controller 150. The scan driver 110 that receives the scan drive control signal SCS sequentially provides the first scan signal to the first scan lines S11 through S1*n*. The scan driver 110 sequentially provides the second scan signal to the second scan lines S21 through S2*n*. Each pixel 140 receives a pair of overlapping scan signals comprising one first scan signal and one second scan signal. The voltage level of the first scan signal is set to turn on a PMOS transistor, and a voltage value of the second scan signal is set to turn off a PMOS transistor. Hereinafter, a driving waveform provided from the scan driver will be described in detail.

During the first portion of each horizontal period, the data driver 120 receives the data drive control signal DCS from the timing controller 150, and provides a voltage of the fourth power source to the data lines D1 through Dm. During the second portion of each horizontal period, the data driver 120 provides the data signal to the data lines D1 through Dm. In some embodiments the voltage level of the fourth power source is the same as the voltage level of the third power source VDC provided to the pixels 140.

The pixel portion 130 receives the first, second and third power sources ELVDD, ELVSS and VDC from an external source. The first, second and third power sources ELVDD, ELVSS and VDC are provided to each of the pixels 140.

Figure 4:
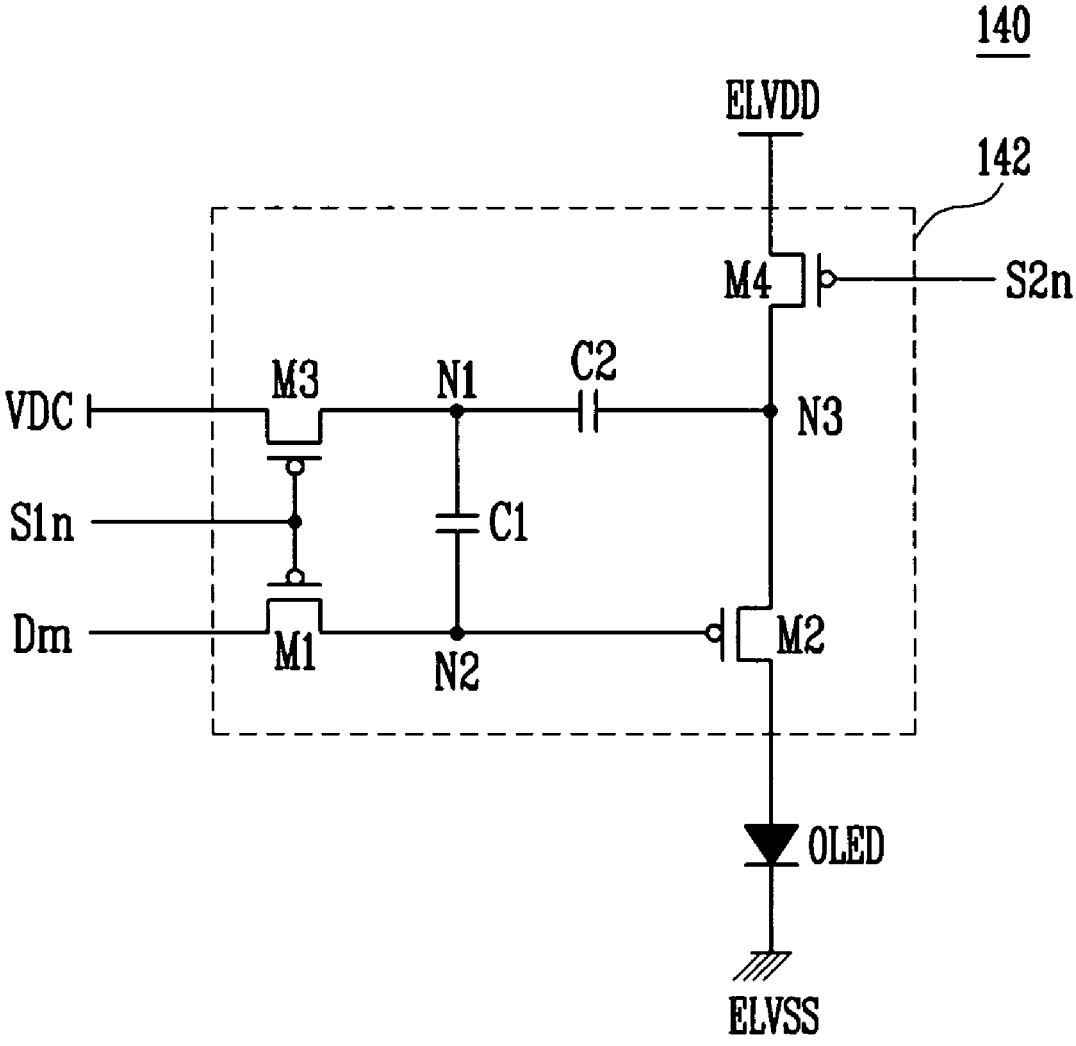
FIG. 4 is a schematic diagram showing one example of the pixel depicted in FIG. 3.

FIG. 4 is a schematic showing one example of the pixel depicted in FIG. 3. FIG. 4 shows a pixel connected to the n-th line of the first scan lines S1*n*, the n-th line of the second scan lines S2*n*, and the m-th data line Dm. The pixel 140 includes an OLED and a pixel circuit 142 for supplying a current to the OLED. The anode of the OLED is connected to the pixel circuit 142, and the cathode is connected to the second power source ELVSS. The voltage value of the second power source ELVSS is less than that of the first power source ELVDD. For example, the voltage value of the second power source ELVSS may be set to be equal to the ground voltage. The OLED, which is connected to the pixel circuit 142, generates light with a brightness corresponding to a current provided from the pixel circuit 142 thereto.

The pixel circuit 142 controls a current which is provided from the first power source ELVDD to the OLED according to the data signal provided from the data line Dm thereto. The pixel circuit 142 includes the first through fourth transistors M1 through M4 and the first and second capacitors C1 and C2.

The gate of the first transistor M1 is connected to the first scan line S1*n*, and the first electrode thereof is connected to the data line Dm. The second electrode of the first transistor M1 is connected to the second node N2. The first transistor M1 is turned on to allow the data line Dm and the second node N2 to be electrically connected when the first scan signal is provided to the first scan line S1*n*.

The gate of the second transistor M2 is connected to the second node N2, and the first electrode thereof is connected to the third node N3. The second electrode of the second transistor M2 is connected to the OLED. The second transistor M2 provides the OLED with a current corresponding to a voltage across the first and second transistors C1 and C2.

The gate of the third transistor M3 is connected to the first scan line S1*n*, and the first electrode thereof is connected to the third power source VDC. The second electrode of the third transistor M3 is connected to the first node N1. The third transistor M3 is turned on to allow the third power source VDC and the first node N1 to be electrically connected when the first scan signal is provided to the first scan line S1*n*. In this embodiment, the voltage level of the third power source VDC is less than that of the first power source ELVDD, and is greater than that of the data signal. For example, when the highest voltage level of the data signal that may be provided from the data driver 120 is 3V, and the voltage of the first power source ELVDD is 6V, the voltage level of the third power source VDC is determined to be between 3 and 6V. These values are used as an example, and other voltage values may also be used.

The gate of the fourth transistor M4 is connected to the second scan line S2*n*, and the first electrode thereof is connected to the first power source ELVDD. The second electrode of the fourth transistor M4 is connected to the third node N3. The fourth transistor M4 is turned off when the second scan signal is provided to the second scan line S2*n*, and is turned on otherwise.

The first capacitor C1 is charged to a voltage that corresponds to the difference between both voltages of the data signal and the third power source VDC. Because the voltage level of the third power source VDC is fixed to a constant level, the voltage level charged in the first capacitor C1 is determined by the voltage level of the data signal. The second capacitor C2 is charged to a voltage corresponding to a threshold voltage of the second transistor M2, such that the sum of the voltages across the capacitors C1 and C2 is equal to the threshold voltage of the second transistor M2.

Figure 5:
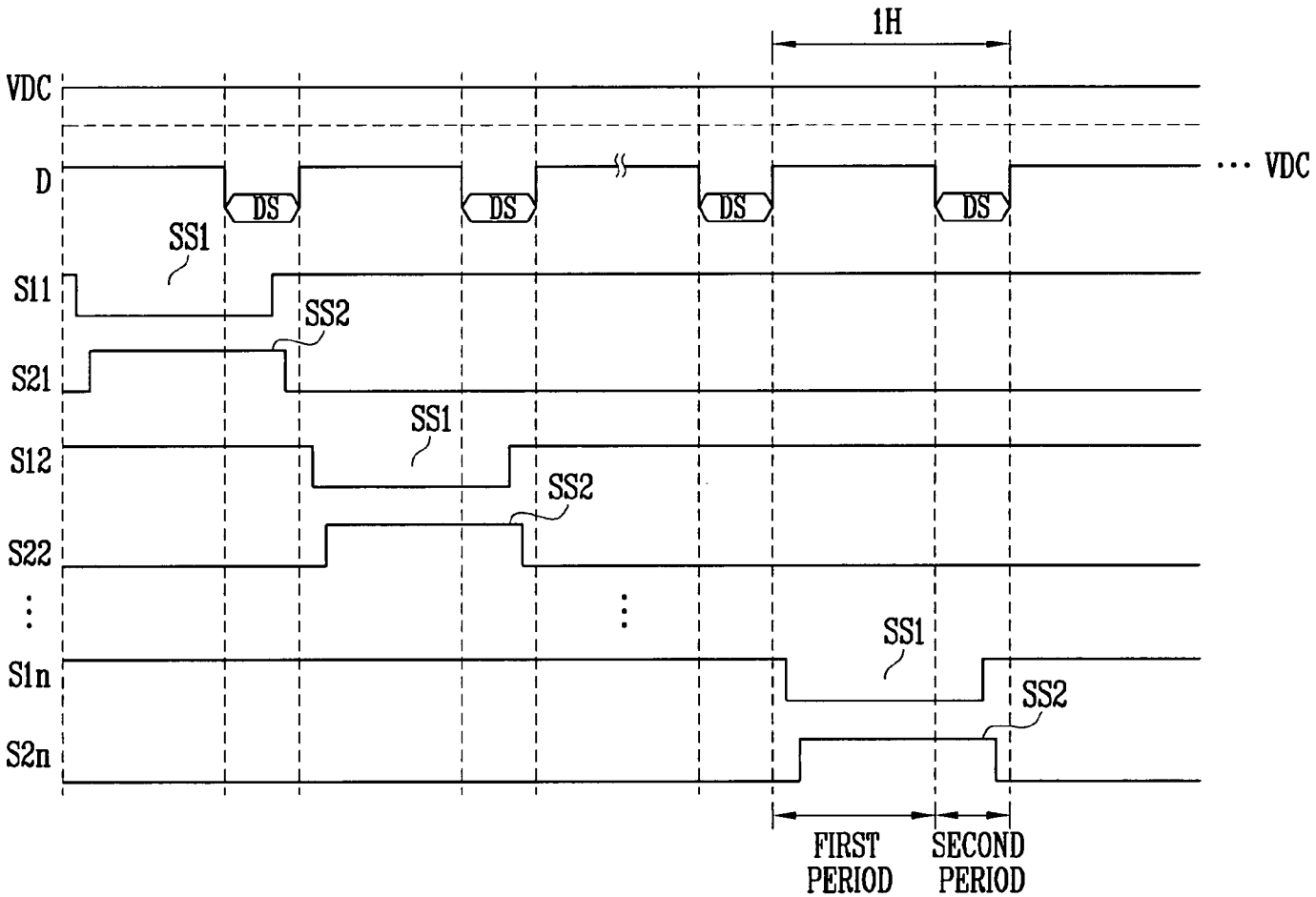
FIG. 5 is a timing diagram showing a driving waveform provided from the scan driver and the data driver depicted in FIG. 3.

FIG. 5 is a timing diagram illustrating a method of driving the organic light emitting display in FIG. 3 comprising the pixel of FIG. 4.

Referring to FIGS. 4 and 5, one horizontal period 1H is divided into a first period and a second period. During the first period, the second capacitor C2 is charged to a voltage corresponding to a threshold voltage of the second transistor M2. During the second period, the first capacitor C1 included in each pixel 140 is charged to a voltage corresponding to the data signal. For doing this, the data driver 120 provides the data lines D1 through Dm with the voltage of the fourth power source during the first period and with the data signal during the second period. In this embodiment, the voltage level of the fourth power source is the same as that of the third power source VDC.

To address the entire array, the scan driver 110 sequentially provides the first scan lines S11 through S1*n* with the first scan signal S11, and sequentially provides the second scan lines S21 through S2*n* with the second scan signal SS2 so as to overlap the first scan signal SS1, as shown in FIG. 5.

Operation of the pixels will be explained in detail with reference to FIG. 4 and FIG. 5. The voltage of the fourth power source is supplied to the data line Dm, and the first scan signal SS1 is provided to the first scan line S1*n* during the first period. The second scan signal SS2 is provided to the second scan line S2*n* during the second period.

When the first scan signal SS1 is provided to the first scan line S1*n* during the first period, the first and third transistors M1 and M3 are turned on. When the first transistor M1 is turned on, the voltage of the fourth power source is provided to the second node N2. When the third transistor M3 is turned on, the voltage of the third power source VDC is provided the first node N1. At this time, since the voltage of the third power source is set to be the same as that of the fourth power source (that is, the voltage of the first node N1 is the same as that of the second node N2), the first capacitor is discharged.

When the second scan signal SS2 is provided to the second scan line S2*n*, the fourth transistor M4 is turned off and the voltage of the third node N3 is set to the voltage of the first power source ELVDD. The voltage of the third node N3 is higher than the voltage applied to the second node N2 by the threshold voltage of the second transistor M2. For this to occur, the voltage of the third node N3 is higher than that of the third power source VDC by at least the threshold voltage of the second transistor M2. Accordingly, during the first period, the second capacitor is charged to a voltage corresponding to the threshold voltage of the second transistor M2.

During the second period, the data signal DS is provided to the data line Dm, and the second node N2 via the first transistor M1. When the data signal DS is provided to the second node N2, the first capacitor C1 is charged to a voltage corresponding to a difference between the third power source VDC and the data signal DS.

Describing this in more detail, the first capacitor C1 is charged to a difference between the voltage of the third power source VDC applied to the first node N1 and the data signal applied to the second node N2. An advantageous aspect of this embodiment is that the third power source VDC providing the voltage for the first node N1 is separate from the first power source ELVDD even if they have the same voltage value. As a large current flows from the first power source ELVDD to drive the OLED, the first power source ELVDD generally has a voltage drop. While this drop may not be a problem for light emission characteristics, such a drop is problematic for charging the first capacitor C1 to the proper voltage. Accordingly, using the third power source VDC for charging the capacitor C1 is advantageous because the third power source VDC does not have such a large voltage drop.

The first scan signal SS1 is stopped at a predetermined time during the second period and the first and third transistors M1 and M3 are turned off. When the first transistor M1 is turned off, the voltage of the second node N2 is varied by a kickback voltage. Accordingly, since the third node N3 is set into a floating state when the fourth transistor M4 is turned off, the voltage of the third node N3 varies according to the voltage variation at the second node N2. That is, because the third node N3 is floating, when the first transistor M1 is turned off, the voltages of the first and second capacitors C1 and C2 do not vary. The first and second capacitors C1 and C2 are connected in serial between the gate and the first electrode of the second transistor M2. Accordingly, if the first electrode of the second transistor M2 is floating, the voltages of the first and second capacitors C1 and C2 are maintained. That is, the current does not vary and an image of consistent brightness can be displayed independent of the kickback voltage.

After the first scan signal SS1 is stopped during the second period, the supply of the second scan signal SS2 is stopped. When the supply of the second scan signal SS2 is stopped, the fourth transistor M4 is turned on. In this case, the voltage of the third node N3 increases to that of the first power source ELVDD. At this time, since the first and second nodes N1 and N2 are floating, the voltage across the first and second capacitors C1 and C2 do not vary. When the fourth transistor M4 is turned on, a current that corresponds to the voltage across the first and second capacitors C1 and C2 is provided from the first power source ELVDD to the OLED. Light corresponding to the current is then generated from the OLED.

Figure 6:
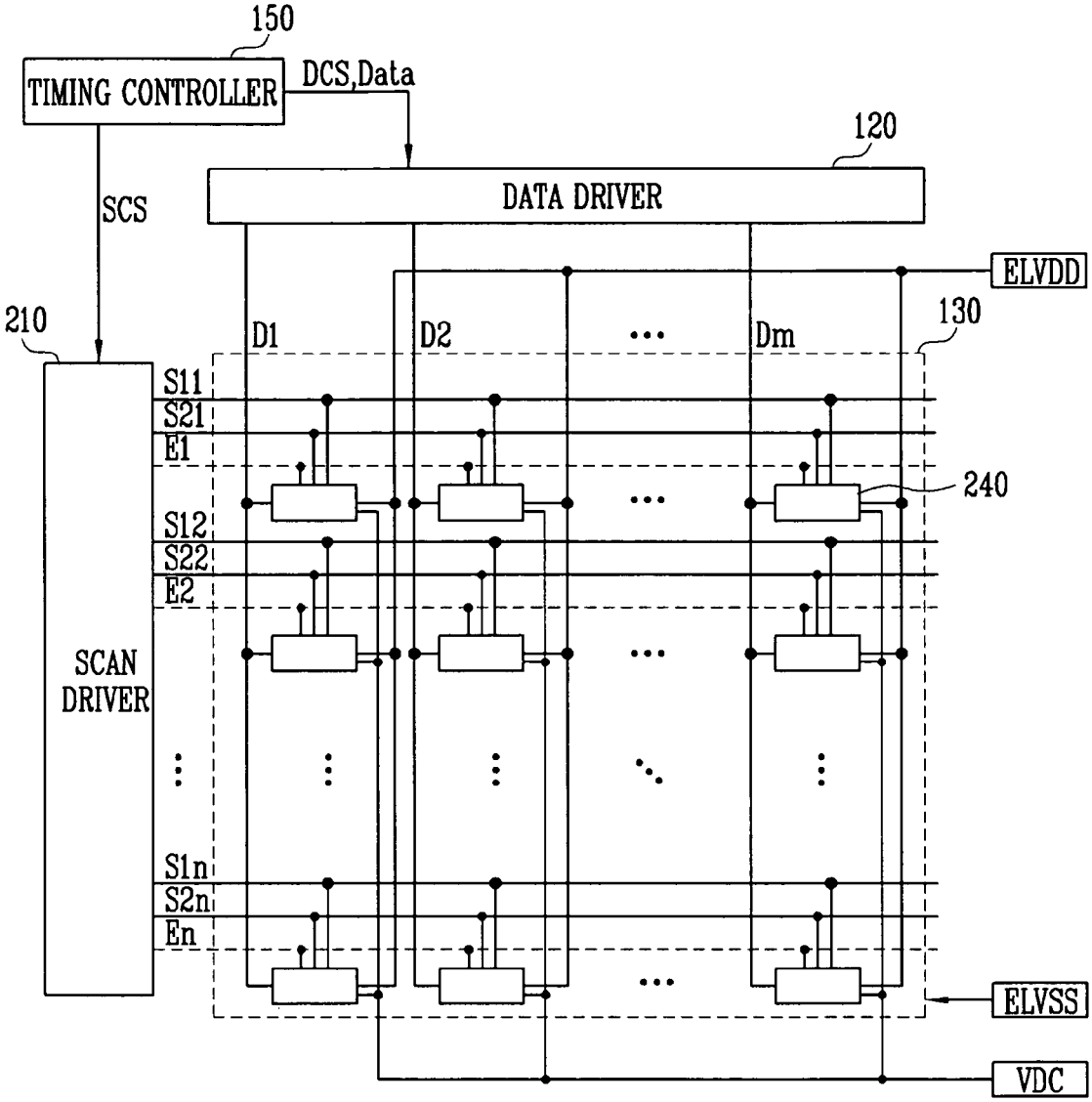
FIG. 6 is a block diagram showing an organic light emitting display according to another embodiment of the present invention.

FIG. 6 is a view showing an organic light emitting display according to another embodiment. When we describe FIG. 6, the same reference numerals are designated for the elements corresponding to elements of the embodiment depicted in FIG. 3, and the detailed illustration for them is omitted.

Referring to FIG. 6, the organic light emitting display according to another embodiment includes a pixel portion 130 including pixels 240 that are formed at a crossing area of the first scan lines S11 through S1*n*, the second scan lines S21 through S2*n*, light emitting control lines E1 through En, and data lines D1 through Dm, a scan driver 210 for driving the first scan lines S11 through S1*n*, the second scan lines S21 through S2*n*, the light emission control lines E1 through En, a data driver 120 for driving the data lines D1 through Dm, and a timing controller 150 for controlling the scan driver 210 and the data driver 120.

The scan driver 210 sequentially provides the first and second scan signals SS1 and SS2 to the first and second scan lines S11 through S1*n* and S21 through S2*n*. The scan driver 210 sequentially provides a light emission signal to the light emission control lines E1 through En. The light emission control signal overlaps the first and second scan signals SS1 and SS2 and ends substantially at the same time as the second scan signal SS2. That is, the light emission control signal is provided during the latter portion of the first period and a first portion of the second period during the one horizontal period.

Figure 7:
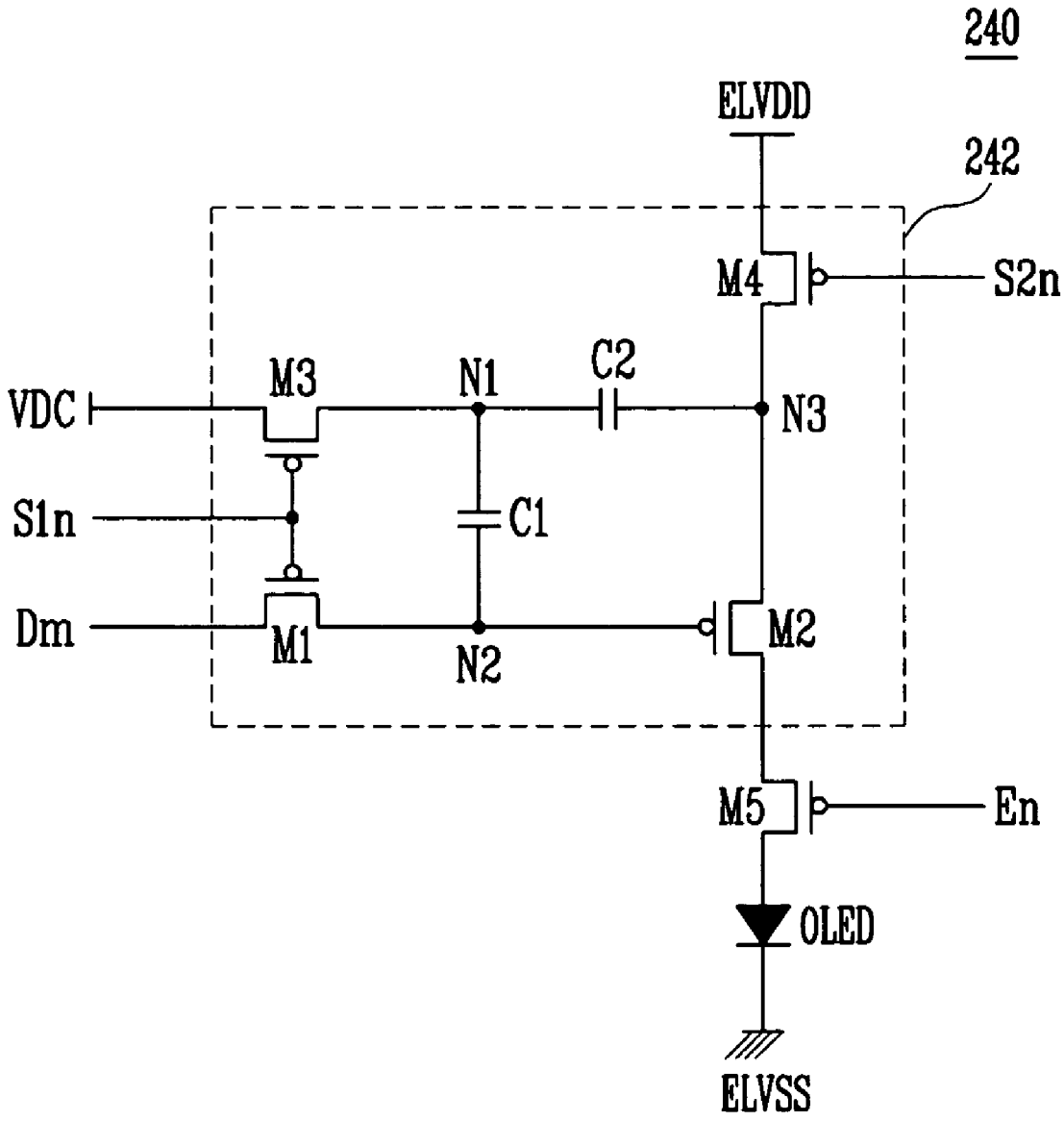
FIG. 7 is a schematic diagram showing one example of the pixel depicted in FIG. 6.

FIG. 7 is a schematic showing one embodiment of the pixel depicted in FIG. 6. The pixel depicted in FIG. 7 is the same as that depicted in FIG. 4 except for a fifth transistor M5. Therefore, the explanation of FIG. 7 is detailed only with respect to the fifth transistor M5.

Referring to FIG. 7, the pixel portion 240 includes a pixel circuit 242 for supplying a current to the OLED.

The OLED generates a light of a brightness corresponding to a current provided from the pixel circuit 242 thereto.

The pixel circuit 242 controls the quantity of the current provided from the first power source ELVDD to the OLED according to the data signal provided from the data line Dm. For doing this, the pixel circuit 242 includes the first through fifth transistors M1 through M5, and the first and second capacitors C1 and C2.

The first electrode of the fifth transistor M5 is connected to the second electrode of the second transistor M2, and the second electrode of the fifth transistor M5 is connected to the OLED. The gate of the fifth transistor M5 is connected to a light emitting control line En. Therefore, the fifth transistor M5 is turned off while the light emission control signal is provided thereto, and turned on otherwise.

Figure 8:
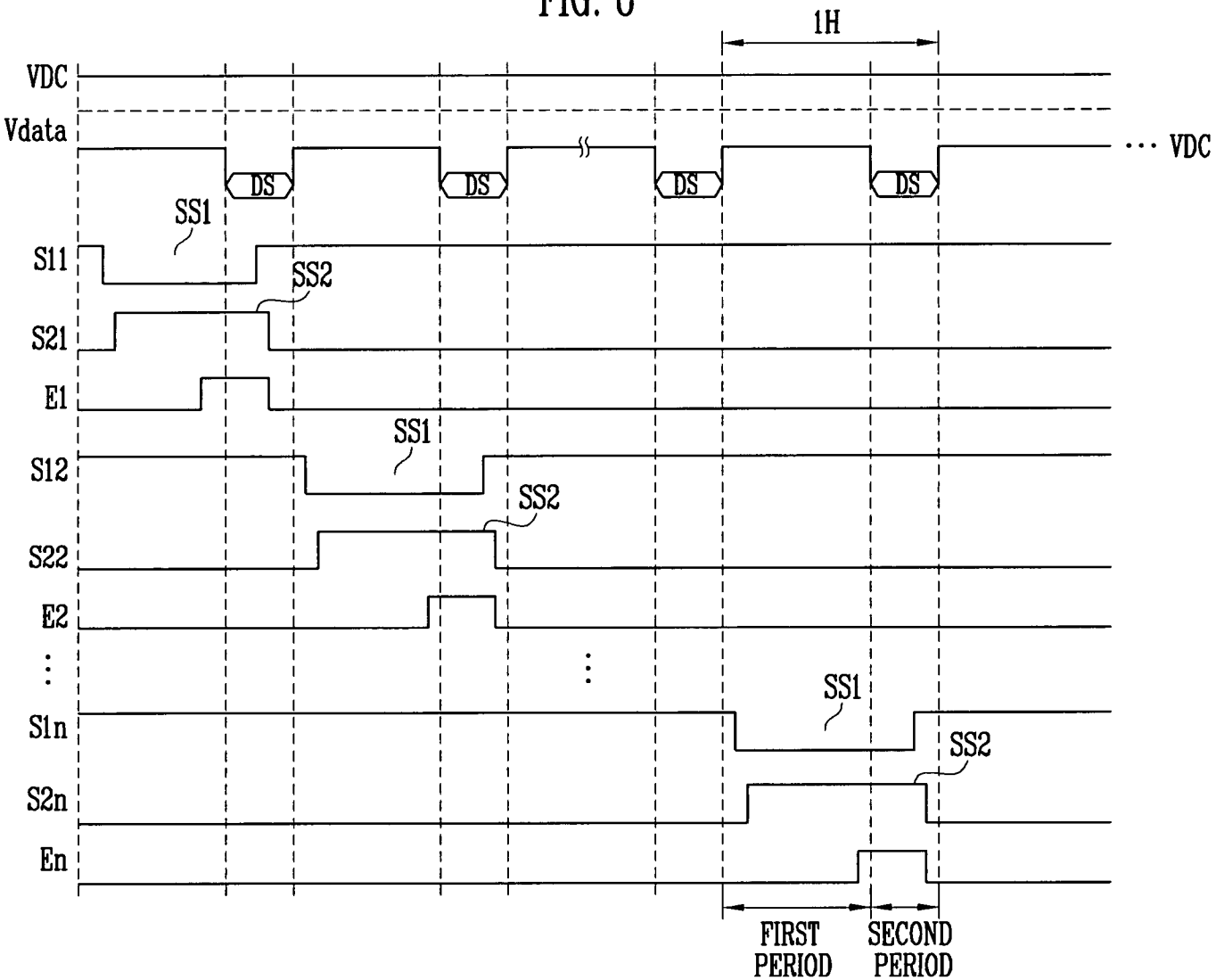
FIG. 8 is a timing diagram showing a driving waveform provided from the scan driver and the data driver depicted in FIG. 6.

FIG. 8 is a timing diagram showing a driving waveform provided from the scan driver and the data driver depicted in FIG. 6. The waveforms in FIG. 8 are the same as those of FIG. 5 except for the light emission control signal. Therefore, the explanation of FIG. 8 is directed to the light emission control signal.

Referring to FIG. 8, the light emission control signal is provided during a latter portion of the first period and a first portion of the second period during each horizontal period. In this embodiment, the supply of the light emission control signal starts before providing the data signal and is stopped before stopping the supply of the data signal DS.

Operation of the pixel is described in detail with reference to FIG. 7 and FIG. 8.

During the first period of the horizontal period 1H, the voltage of the fourth power source is provided to the data line Dm. And, during the first period, the first scan signal SS1 is provided to the first scan line S1*n*, and the second scan signal SS2 is provided to the second scan line S2*n*.

When the first scan signal SS1 is provided to the first scan line S1*n* during the first period, the first and third transistors M1 and M3 are turned on. When the first transistor M1 is turned on, the voltage of the fourth power source is provided to the second node N2. When the second scan signal SS2 is provided to the second scan line S2*n*, the first and third transistors M1 and M3 are turned on. When the first transistor M1 is turned on, the voltage of the third power source is provided to the first node N1. At this time, since the voltage of the third power source VDC is the same as that of the fourth power source, the first capacitor C1 is discharged.

When the second scan signal SS2 is provided to the second scan line S2*n*, the fourth transistor M4 is turned off and the voltage of the third node N3 is set to that of the first power source ELVDD. The voltage of the third node N3 is higher than the voltage applied to the second node N2 by the threshold voltage of the second transistor M2, such that the second capacitor is charged to a voltage corresponding to the threshold voltage of the second transistor M2.

After the voltage corresponding to the threshold voltage of the second transistor M2 is charged in the second capacitor C2, the light emission control signal is provided to the light emission control line En and the fifth transistor M5 is turned off.

The data signal DS is then provided to the data line Dm during the second period. The data signal provided to the data line Dm is provided to the second node N2 via the first transistor M1. When the data signal is provided to the second node N2, the first capacitor C1 is charged to a voltage corresponding to the difference between the voltage of the third power source VDC and the data signal DS. Accordingly, the first capacitor C1 is charged to a desired voltage corresponding to the data signal DS.

Describing this in more detail, the first capacitor C1 is charged to a difference voltage between the third power source VDC applied to the first node N1 and the data signal applied to the second node N2. An advantageous aspect of this embodiment is that the third power source VDC providing the VDC for the first node N1 is separate from the first power source ELVDD even though they have the same voltage. As a large current flows from the first power source ELVDD to drive the OLED, the first power source ELVDD generally has a voltage drop. While this drop may not be a problem for light emission characteristics, such a drop is problematic for charging the first capacitor C1 to the proper voltage. Accordingly, using the third power source VDC for charging the capacitor C1 is advantageous because the third power source VDC does not have such a large voltage drop.

The first scan signal SS1 is stopped at a predetermined time during the second period, and the first and third transistors M1 and M3 are turned off. When the first transistor M1 is turned off, the voltage of the second node N2 is varied by a kickback voltage. , Since the third node N3 is floating, the voltage of the third node N3 varies according to the voltage variation of the second node N2, and the voltages across the first and second capacitors C1 and C2 do not vary.

After the first scan signal SS1 is stopped, the supplies of the second scan signal SS2 and the light emission control signal are stopped. When the supply of the second scan signal SS2 is stopped, the fourth transistor M4 is turned on, such that the voltage of the third node N3 increases to that of the first power source ELVDD. Since the first and second nodes N1 and N2 are floating, the voltage at the second node N2 varies according to the voltage variation of the third node N3. Therefore, the voltages across the first and second capacitors C1 and C2 do not vary. When the supply of the light emission control signal is stopped, the fifth transistor M5 is turned on. At this time, a current that corresponds to the voltage across the first and second capacitors C1 and C2 is provided from the first power source ELVDD to the OLED. Light corresponding to the current is then generated from the OLED.

Figure 9:
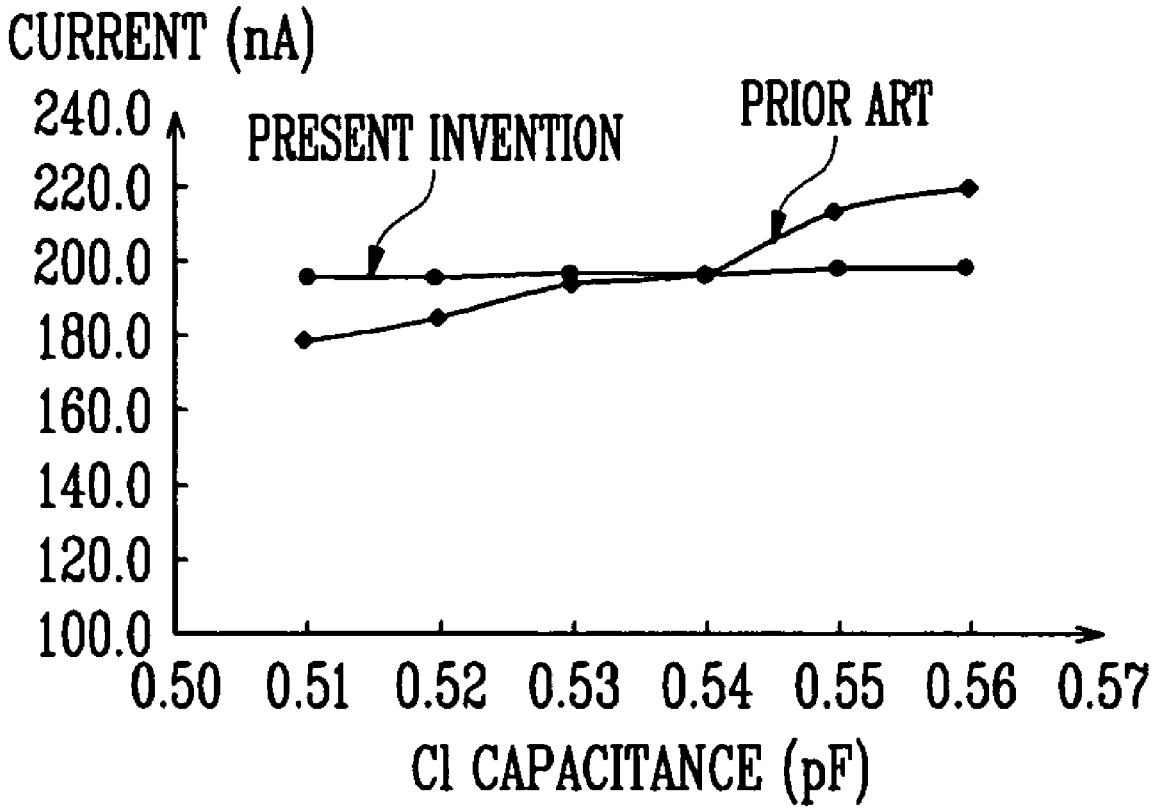
FIG. 9 is a graph showing a current provided to an organic light emitting diode corresponding to a capacitance variation of a capacitor.

FIG. 9 is a graph showing a current provided to an organic light emitting diode corresponding to the capacitance of the first capacitor C1. In FIG. 9, the X axis denotes a capacitance of the first capacitor C1 and Y axis denotes a quantity of current flowing through the OLED.

Referring to FIG. 9, in the prior art pixel, the current provided to the OLED depends on the capacitance of the first capacitor C1. In the prior art pixel, because of the kickback voltage, the larger the capacitance of the first capacitor C1, the larger the amount of current provided to the OLED. As mentioned above, when the quantity of current flowing through the OLED depends on the capacitance of the first capacitor C1, luminance is not uniform across the display.

On the contrary, in the pixel of embodiments shown herein, the quantity of current provided to the OLED is independent of the capacitance of the first capacitor C1. Namely, the quantity of current provided to the OLED can be uniformly maintained independent of the kickback voltage, and an image of desired and uniform luminance can be displayed.

Although a few embodiments of the present invention have been shown and described, it would be appreciated by those skilled in the art that changes might be made in this embodiment without departing from the principles and spirit of the invention.

What is claimed is:

1. A pixel circuit comprising:

a first capacitor and a second capacitor;

a first transistor configured to turn on when a first scan signal is provided from a first scan line to the first transistor so as to electrically connect a data line with a first terminal of the first capacitor;

a second transistor comprising a gate which is connected to the first terminal of the first capacitor, the second transistor further comprising a first electrode which is connected to a first terminal of the second capacitor;

a third transistor configured to turn on when the first scan signal is provided to the third transistor so as to provide a first voltage to the second terminal of the first capacitor and the second terminal of the second capacitor;

a fourth transistor connected to the first electrode of the second transistor and to a first power source, the fourth transistor configured to turn off when the second scan signal is supplied from the second scan line to the fourth transistor, and to turn on when the second scan signal is not supplied from the second scan line to the fourth transistor; and an organic light emitting diode coupled between the second transistor and a second power source.

2. The pixel circuit of claim 1, wherein the fourth transistor is configured to be off during a time when the first transistor is on so as to allow the first terminal of the second capacitor to be in a substantially floating state.

3. The pixel circuit as claimed in claim 1, wherein the first transistor is configured to be off during a time when the fourth transistor is on so as to allow the first terminal of the first capacitor to be in a substantially floating state.

4. The pixel circuit of claim 1, wherein the first voltage is provided to the data line during a time when the first scan signal is provided to the pixel circuit so as to allow a voltage corresponding to a threshold voltage of the second transistor to be stored across the second capacitor.

5. The pixel circuit of claim 4, wherein a voltage corresponding to a data signal is stored across the first capacitor by providing the data signal to the data line after the voltage corresponding to the threshold voltage of the second transistor is stored across the second capacitor.

6. The pixel circuit of claim 1, wherein the second transistor provides a current from the first power source to the organic light emitting diode, the current corresponding to a voltage stored across the first capacitor and the second capacitor.

7. The pixel circuit of claim 5, further comprising a fifth transistor which is connected to the second transistor and to the organic light emitting diode, the fifth transistor configured to turn off when a light emission control signal is provided to the fifth transistor and configured to turn on when the light emission control signal is not provided to the fifth transistor.

8. The pixel circuit of claim 7, wherein the fifth transistor is configured to turn off during a time when a voltage corresponding to the data signal is stored across the first capacitor and configured to turn on during a time when the voltage corresponding to the data signal is not stored across the first capacitor.

9. An organic light emitting display, comprising:

a data driver configured to provide a first voltage to one or more data lines during a first period of each of a plurality of horizontal periods and to provide a data signal to the one or more data lines during a second period of each of the plurality of horizontal periods;

a scan driver configured to provide a first scan signal to one or more first scan lines during a portion of the first period and during a portion of the second period, and to provide a second scan signal to one or more second scan lines; and a pixel circuit portion comprising one or more pixels which are each connected to the data lines, the first scan lines and the second scan lines, wherein each of the plurality of pixels includes:

an organic light emitting diode coupled between a first power source and a second power source, and a pixel circuit coupled between the organic light emitting diode and the first power source, the pixel circuit connected to the first scan lines, the second scan lines, the data lines and a third power source configured to generate the first voltage, the pixel circuit configured to provide the organic light emitting diode with a current corresponding to the data signal.

10. The organic light emitting display of claim 9, wherein the pixel circuit includes:

a second transistor having a gate and a first electrode, wherein a first capacitor and a second capacitor are positioned in serial between the gate and the first electrode;

a first transistor configured to turn on when the first scan signal is provided, the first transistor configured to electrically connect the data line to the gate of the second transistor;

a third transistor configured to turn on when the first scan signal is provided, the third transistor configured to electrically connect the third power source to a terminal of a first capacitor and a terminal of a second capacitor; and a fourth transistor connected between the second transistor and the first power source, the fourth transistor configured to turn off if the second scan signal is provided and to turn on if the second signal is not provided.

11. The organic light emitting display of claim 10, wherein a voltage corresponding to a threshold voltage of the second transistor is stored across the second transistor during the first period.

12. The organic light emitting display of claim 11, wherein a voltage corresponding to a difference between the data signal and the third power source is stored across the first capacitor during the second period;

wherein the forth transistor is configured to be off during a time when the first transistor is on so as to allow the first terminal of the second capacitor to be in a substantially floating state.

13. The organic light emitting display of claim 10, wherein the scan driver is configured to stop the second scan signal after providing the first scan signal, such that a first electrode of the second transistor is in a substantially floating state during a time when the first transistor is turned off.

14. The organic light emitting display of claim 13, wherein the scan driver is configured to stop the second scan signal to turn on the fourth transistor during a time when the second transistor is in a substantially floating state.

15. The organic light emitting display of claim 14, wherein after the fourth transistor is turned on, the second transistor provides a current corresponding to a voltage stored across the first and second capacitors, wherein the current is provided from the first power source to the second power source via the organic light emitting diode.

16. The organic light emitting display of claim 9, wherein a value of the voltage of the third power source is less than the value of the voltage of the first power source.

17. The organic light emitting display of claim 9, wherein a value of the voltage of the third power source is greater than the value of the voltage of the data signal.

18. The organic light emitting display of claim 10, wherein the scan driver is further configured to provide a light emission control signal to a light emission control line during a latter portion of the first period and a beginning portion of the second period, wherein the emission control line is connected to the one or more pixels.

19. The organic light emitting display of claim 18, wherein the pixel circuit further comprises a fifth transistor connected to the second transistor and the organic light emitting diode, wherein the fifth transistor is off when the light emission control signal is provided to the fifth transistor, and is on when the light emission control signal is not provided to the fifth transistor.

20. A method of driving an organic light emitting display, comprising the steps of:

providing a first voltage to data lines during a first period of a horizontal period;

providing a data signal to the data lines during a second period of the horizontal period;

providing a first scan signal to a first one or more scan lines during a portion of the first period and during a portion of the second period; and providing a second scan signal to a second one or more scan lines during a portion of the first period and during a portion of the second period, wherein a first capacitor is charged to a voltage corresponding to a threshold voltage of a transistor during the first period, and a second capacitor is charged to a voltage corresponding to the data signal during the second period.

21. The method of claim 20, further comprising placing a terminal of one of the first and second capacitors in a substantially floating state during a time when the other of the first and second capacitors is being charged, wherein the first capacitor and the second capacitor are serially connected between a gate and a first electrode of the transistor.

* * * * *